United States Patent [19]

Edwards et al.

[11] Patent Number: 4,820,202

[45] Date of Patent: Apr. 11, 1989

[54] STRESS-FREE FILTER ARRAY FOR MULTI-WAY CONNECTORS

[75] Inventors: Geoffrey S. Edwards, Grange-over-Sands; Trevor Armistead, Ulverston, both of England

[73] Assignee: Oxley Development Company Limited, London, England

[21] Appl. No.: 195,533

[22] Filed: May 18, 1988

[30] Foreign Application Priority Data

May 21, 1987 [GB] United Kingdom ..... 8711998

[51] Int. Cl.[4] ..... H01R 13/66

[52] U.S. Cl. ..... 439/620; 439/246; 439/271; 333/185

[58] Field of Search ..... 439/246–248, 439/620, 426, 271, 276; 333/181–185

[56] References Cited

U.S. PATENT DOCUMENTS

| | | | |
|---|---|---|---|
| 4,699,590 | 10/1957 | Farrar et al. | 439/620 |
| 4,729,743 | 3/1988 | Farrar et al. | 439/620 |
| 4,741,710 | 5/1988 | Hogan et al. | 333/185 |
| 4,746,310 | 5/1988 | Morse et al. | 439/620 |

FOREIGN PATENT DOCUMENTS

| | | | |
|---|---|---|---|
| 0091867 | 4/1983 | European Pat. Off. | 439/620 |

*Primary Examiner*—Gary F. Paumen

*Attorney, Agent, or Firm*—Staas & Halsey

[57] ABSTRACT

A multi-way connector incorporating an integral filter array and comprising a metal outer casing; an inner housing in the form of a solid block of an electrically insulating material disposed within the outer casing; and a plurality of electrical contacts (plugs or sockets) having lead-through terminations which extend through the housing block, the free ends of said terminations extending from the block carrying respective filter capacitors whose outer electrodes are connected electrically to a metal ground plane which is itself connected electrically to the metal outer casing. Disposed around each lead-through termination is a respective collet which is received within a respective recess in the housing block so as to firmly grip that termination (100) to relieve same of mechanical stresses during connection of a mating connector part with said contacts. The free ends of the lead-through terminations, outboard of the filter capacitors, extend through respective holes in a rigid plate of electrically insulating material in such a manner as to prevent mechanical stresses in said terminations during the soldering of components thereto and/or during handling of the connector. The outer periphery of the plate is not connected rigidly to the outer casing. The exposed surfaces are provided with a conformal coating of a flexible protective layer, such as polyurethane or an epoxy.

6 Claims, 4 Drawing Sheets

STRESS-FREE FILTER ARRAY FOR MULTI-WAY CONNECTORS

DESCRIPTION

Figure 1:
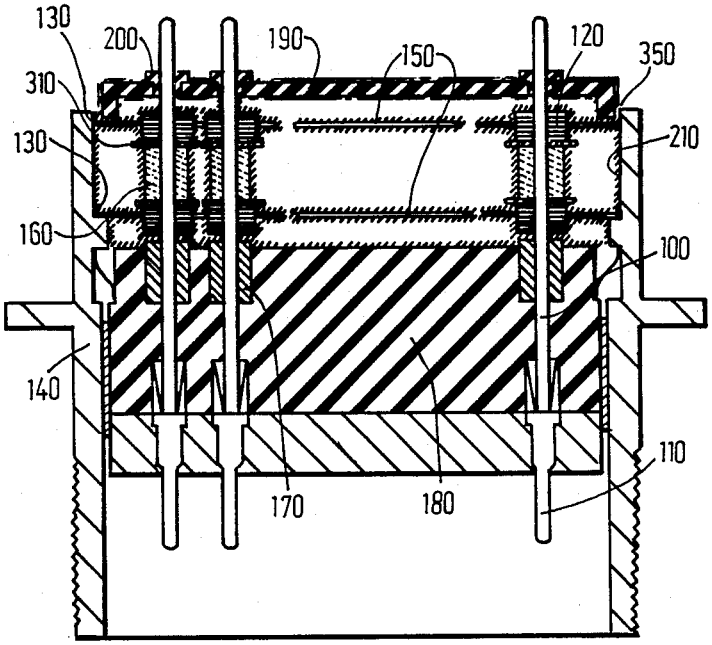

The present invention relates to multi-way connectors for electrical circuitry and is concerned in particular with the provision of a stress free integral filter array for such multi-way connectors.

In the provision of filter devices to suppress interference on signal and power lines, there are substantially advantages to be gained if the devices can be reliably incorporated within the confines of a multi-way connector. Not only does this utilise space most economically, but the filters have the shortest and therefore potentially the least impedance ground return path to provide the optimum filtering characteristics at high frequencies. This potential is only fully realised if the filters are grounded with a low resistance contact and preferably this should be an integral contact such as a solder joint and not a pressure contact which is also susceptible to the environment (shock and vibration) and corrosive or humid ambients. The filters themselves should be protected from the environment and also from mechanical stresses imposed via the contact when the connector is mated and also via the rear terminations when the connector is soldered or otherwise connected to external circuitry.

The present invention is concerned with the problem of providing such a stress free environmentally protected filter construction to fit within a multi-way connector.

Conventional constructions use filters with ceramic tubes as the capacitive elements which are encapsulated with epoxy, silicone or similar materials to protect the filters. With thermal cycling however, the inevitable thermally induced stresses eventually crack the brittle ceramic tubes. These cracks produce leakage paths within the filter and consequent device failures. Even though silicone materials are relatively flexible compared to epoxy and filled epoxy systems and therefore reduce thermal stresses, mechanical stresses encountered at mating of the connector or on soldering the terminations are not constrained. An alternative is to encapsulate first with flexible silicone and protect from mechanically imposed stressed with a second encapsulation of rigid epoxy. However, hydraulic pressure can be produced in the constrained silicone to again produce stress induced damage.

Other known filter constructions for multi-way connectors use planar capacitive arrays which can be in the form of multi-way discs pierced with holes and internal electrodes arranged to provide in the monolithic structure a capacitor to ground between each metallised hole and the circumference of the planar array. The dielectric ceramics material used in these planar arrays inevitably has a substantially different temperature coefficient of expansion compared to the case of the multi-way connector and thermal cycling again produces inevitable stresses. In addition the mechanical stress from the contacts during mating of the connector and at the terminations needs to be mechanically isolated from the brittle array and this together with the need for encapsulation for environment protection necessitates the use of a rigid epoxy with ensuing thermally induced stresses during thermal cycling.

An additional problem with planar arrays is that the grounding plane which forms part of the multi-way array is a buried metallic track which is inevitably of relatively high resistance compared to a discrete metal earth plane. This distributed resistance in the ground plane of the planar array can also introduce undesirable crosstalk between signal paths within the same multi-way connector.

A further problem is the difficulty of providing accurately positioned holes in the planar array due to the shrinkage during firing and this can exacerbate the mechanical stress introduced via the contacts when the connector is mated.

The provision of different filtering characteristics within a single planar array is also not convenient; the reliable construction of pi-section filters, which are desirable in many applications to optimise the filtering characteristics, is similarly not convenient.

It is a principal object of the present invention to provide a construction with substantial advantages over the constructions described above.

In accordance with the present invention, there is provided a multi-way connector incorporating an integral filter array and comprising:

(a) a metal outer casing;

(b) an inner housing in the form of a solid block of an electrically insulating material disposed within the outer casing;

(c) a plurality of electrical contacts (plugs or sockets) having lead-through terminations which extend through the housing block, the free ends of said terminations extending from the block carrying respective filter capacitor whose outer electrodes are connected electrically to a metal ground plane which is itself connected electrically to the metal outer casing;

(d) there being disposed around each lead-through termination a respective collet which is received within a respective recess in the housing block so as to firmly grip that termination to relieve same of mechanical stresses during connection of a mating connector part with said contacts, and (e) the free ends of the lead-through terminations, outboard of the filter capacitors, extending through respective holes in a rigid plate of electrically insulating material in such a manner as to prevent mechanical stresses in said terminations during the soldering of components thereto and/or during handling of the connector, the outer periphery of the latter plate not being connected rigidly to the outer casing.

Preferably, the exposed surfaces of said metal ground plane, the terminations, the filter capacitors, the surface of said housing block and the inner surface of the outer casing, disposed within the chamber defined by said plate, the outer casing, and the housing block, are provided with a conformal coating of a flexible protective layer, such as polyurethane or an epoxy.

Advantageously, each termination is located in the respective holes in said rigid plate by means of respective stepped bushes which are fixed in position by means of a resilient adhesive.

The outer periphery of the rigid plate can be sealed to the outer casing by means of a flexible elastomer.

The invention is described further hereinafter, by way of example only, with reference to the accompanying drawings, in which:

FIG. 1 is a diagrammatic longitudinal section through one embodiment of a multi-way connector in accordance with the present invention, and FIGS. 2 to 6 are sectional views illustrating various steps in the assembly of the connector of FIG. 1.

FIG. 1 shows a multi-way connector with an array of pi-section filters assembled to the lead-through terminations 100 of contacts 110. Each filter comprises two discoidal, multi-layer capacitors 120 soldered directly to the lead-through termination and also to two metal ground planes 150 which in turn are soldered at 130 to the case 140 of the connector, with a ferrite tube 160 arranged on each lead-through between the two discs.

Mechanical stresses from the contact mating are eliminated by using collets 170 (preferably metal collets) which are inserted into counterbores on the rear of the insulated connector housing 180. When pressed in place, each collet firmly grips the lead-through termination as the outer surfaces bear on the inside of the counterbore in the rigid rear insulation 180.

In order to prevent mechanical stresses from the ends of the terminations during soldering or handling being transmitted to the filter, a rigid disc 190 in an insulating material similar to the connector housing 180 is fitted over the ends of the terminations as a final assembly operation. In this operation, the disc of rigid insulation, pierced with an array of equal sized clearance holes, is fitted in place loosely over the ends of the terminations and stepped bushes 200 are fitted over each termination and glued in place with a resilient adhesive to take up alignment tolerances without stressing the filter array. In particular, the outer circumference of the rigid disc of insulation 190 is arranged so that it is not in contact with the case 140 of the connector, thus eliminating the stresses that would have been produced by the differential thermal expansion of the filter array and the connector case. Alternatively, this stress relief gap between the rear insulation disc and the case can be fitted, for example, with a flexible elastomer whereby to seal the rear of the connector. Preferably, the rear terminations are also coated with a flexible conformal coat after the solder joints have been made to the external wiring to ensure the integrity of this seal.

The internal construction of the filter array is also advantageously conformally coated as indicated at 210 with a flexible protective layer such as polyurethane or epoxy. This provides the necessary environmental protection for the filter array whilst preventing the thermally induced stresses associated with 'bulk' encapsulation.

The procedure for assembly of a typical pi-section filter array into the multi-way connector is described as follows by reference to FIGS. 1 to 6.

Figure 2:
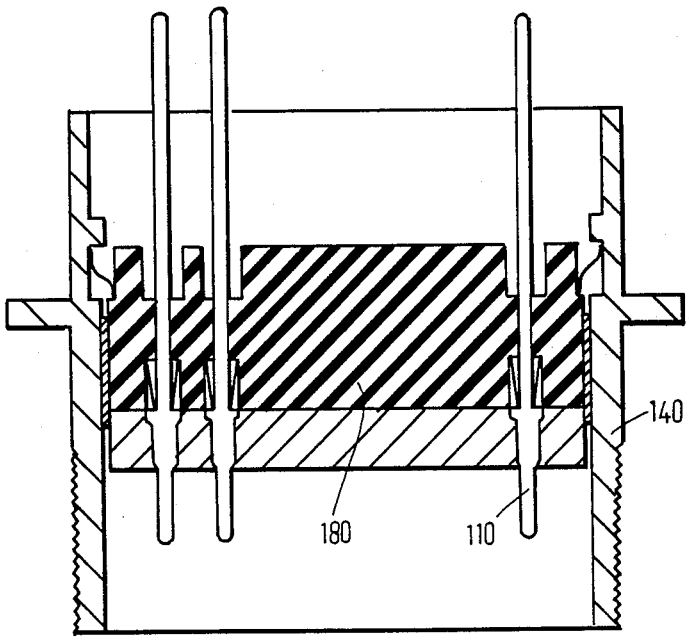
Figure 3:
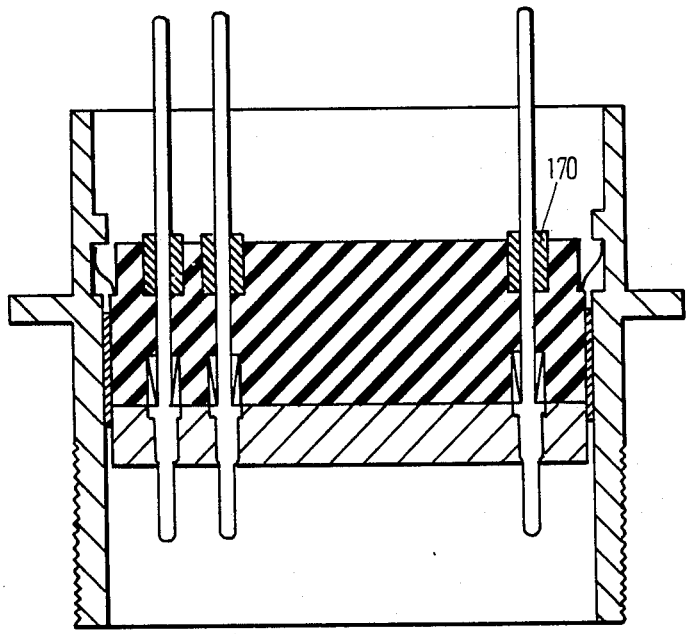

First, the contacts 110 are inserted into the connector insulator housing 180 from the rear in the conventional way as shown in FIG. 2. The collets 170 are then fitted into the counterbores in the connector housing to firmly grip the lead-through terminations 100 of the contact as shown in FIG. 3.

Figure 4:
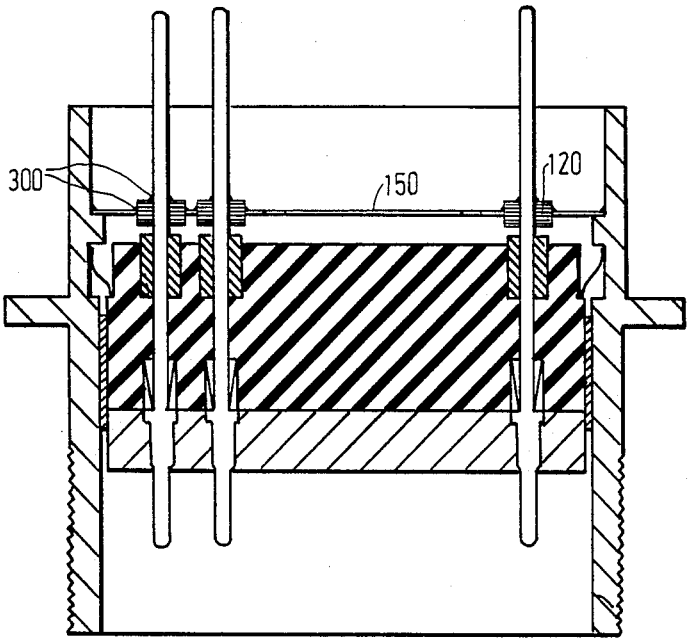

A filter array is made by soldering the discoidal multi-layer capacitors 120 onto a thin flexible metal ground plane 150 at 300 as shown in FIG. 4. This filter array is then fitted over the lead-through terminations, the metallised central hole in each discoidal capacitor is soldered to the lead-through termination and the circumference of the ground plane soldered to the inner surface of the connector case at 300 as shown in FIG. 4.

Figure 5:
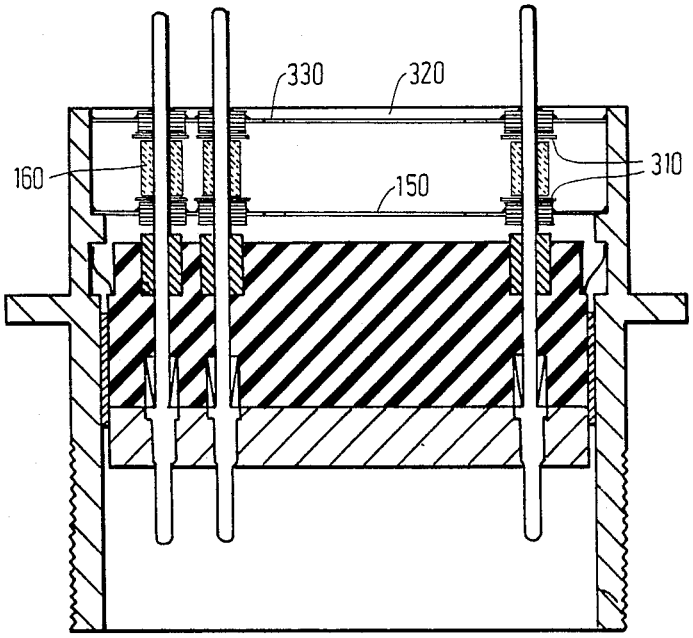

Insulation bushes 310 and ferrite tubes 160 are then fitted onto each lead-through termination and a second filter array 320 soldered in place in a similar manner as the first filter array, as shown in FIG. 5.

Figure 6:
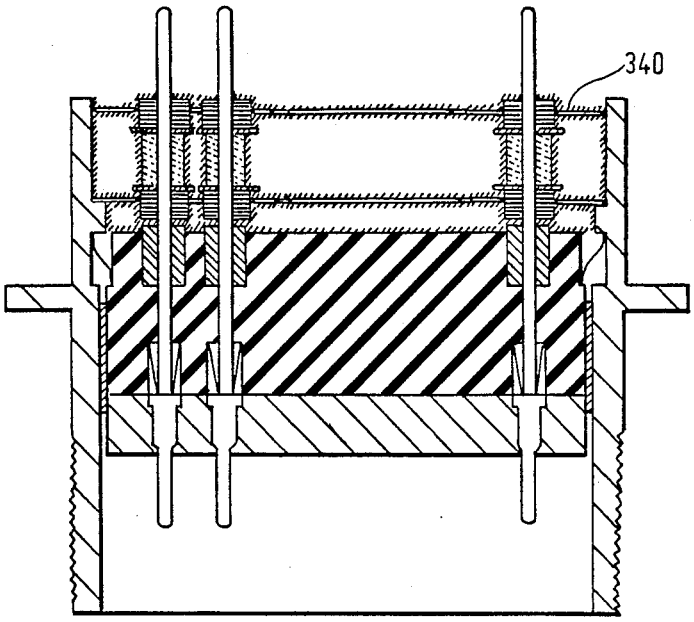

The ground planes, in addition to being provided with holes to accommodate the discoidal capacitors are also pierced with several holes 330 (FIG. 5), the purpose of which is to now allow the internal construction to be cleaned and conformal coating 340 to be applied to the whole of the internal construction to provide the necessary stress free protective coating as shown in FIG. 6.

The outer insulator disc 190 is then fitted over the ends of the lead through termination as shown in FIG. 1 and the stepped bushes 200 glued to place, using resilient adhesive, to provide stress free fixing of the lead-through termination.

It should be noted that in this construction the alignment of the contacts 110 and the lead-through terminations 100 as determined by the connector housing and fixed by the collets is maintained without radial stresses throughout the assembly procedure. All thermally induced differential stresses are taken up by the thin metal ground planes flexing to allow axial movement of the filter array whilst axial differential thermal expansion of the lead-through terminations with respect to the connector is unrestrained and stress free because the rear insulation disc is not fixed to the connector case at its circumference 350 (FIG. 1). This stress relieve gap 350 can also be fitted with a flexible elastomer for environmental sealing purposes as mentioned above.

Radial thermal stresses between the multi-layer discoidal capacitors and the metal ground plane are absorbed by the flexibility of the ground plane and also by the plastic nature of the solder joint itself.

A particular feature of this construction compared to planar capacitor arrays is that each discoidal element can be selected for capacitance values and integrity prior to being incorporated into the array. Not only does this allow for balanced filtering where close capacitance tolerances are required in certain applications, but different capacitance values can conveniently be incorporated in one array depending on the particular filtering required, e.g. where power line and signal line filters must be mixed on one connector.

Although the above describes a specific pi-section filter arrangement in a circular multi-way connector, the present construction can also be applied advantageously to capacitive or L-section filter configurations and other types of multi-way connector, e.g. rectangular styles.

We claim:

1. A multi-way connector incorporating an integral filter array, comprising:

(a) a metal outer casing;

(b) an inner housing in the form of a solid block of an electrically insulating material disposed within the outer casing;

(c) a plurality of electrical contacts having lead-through terminations which extend through the housing block, the free ends of said terminations extending from the block carrying respective filter capacitors whose outer electrodes are connected electrically to a metal ground plane which is itself connected electrically to the metal outer casing;

(d) there being disposed around each said lead-through termination a respective collet which is received within a respective recess in the housing block so as to firmly grip said termination to relieve same of mechanical stresses during connection of a mating connector part with said contacts, and (e) the free ends of the lead-through terminations, outboard of the filter capacitors, extending through respective holes in a rigid plate of electrically insulating material in such a manner as to prevent mechanical stresses in said terminations during the soldering of components thereto and during handling of the connector, the outer periphery of the plate not being connected rigidly to the outer casing to allow slight movement of the ends of said terminations.

2. A multi-way connector as claimed in claim 1, wherein the exposed surfaces of said metal ground plane, the terminations, the filter capacitors, the surface of said housing block and the inner surface of the outer casing, disposed within a chamber defined by said plate, the outer casing, and the housing block, are provided with a conformal coating of a flexible protective layer.

3. A multi-way connector as claimed in claim 1, wherein each termination is located in the respective holes in said rigid plate by means of respective stepped bushes which are fixed in position by means of a resilient adhesive.

4. A multi-way connector as claimed in claim 3, wherein the outer periphery of the rigid plate is sealed to the outer casing by means of a flexible elastomer.

5. A multi-way connector as claimed in claim 2, wherein said flexible protective layer is made of one of polyurethane and an epoxy resin.

6. A multi-way connector incorporating an integral filter array, comprising:

(a) a metal outer casing;

(b) an inner housing in the form of a solid block of an electrically insulating material disposed within the outer casing;

(c) a plurality of electrical contacts having lead-through terminations which extend through the housing block, the free ends of said terminations extending from the block carrying respective filter capacitors whose outer electrodes are connected electrically to a metal ground plane which is itself connected electrically to the metal outer casing;

(d) there being disposed around each said lead-through termination a respective collet which is received within a respective recess in the housing block so as to firmly grip said termination to relieve same of mechanical stresses during connection of a mating connector part with said contacts, and (e) the free ends of the lead-through terminations, outboard of the filter capacitors, extending through respective holes in a rigid plate of electrically insulating material and being located therein by means of respective stepped bushes which are fixed in position in said holes by means of a resilient adhesive, the outer periphery of said rigid plate being sealed to the outer casing by means of a flexible elastomer.

* * * * *